US007352330B2

(12) United States Patent
Komine

(10) Patent No.: US 7,352,330 B2
(45) Date of Patent: Apr. 1, 2008

(54) PORTABLE TERMINAL INCLUDING ANTENNA

(75) Inventor: Yasushi Komine, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/094,246

(22) Filed: Mar. 31, 2005

(65) Prior Publication Data

US 2006/0092082 A1 May 4, 2006

(30) Foreign Application Priority Data

Oct. 28, 2004 (JP) ..... 2004-314175

(51) Int. Cl.
*H01Q 1/24* (2006.01)

(52) U.S. Cl. ..... 343/702; 343/700 MS; 455/575.3; 455/575.7

(58) Field of Classification Search ..... 343/702, 343/720, 866, 700 MS; 455/575.5, 575.7
See application file for complete search history.

(56) References Cited

U.S. PATENT DOCUMENTS

| | | | | |
|---|---|---|---|---|
| 6,266,020 | B1 * | 7/2001 | Chang | 343/702 |
| 6,577,280 | B2 * | 6/2003 | Kim | 343/702 |
| 6,670,926 | B2 * | 12/2003 | Miyasaka | 343/702 |
| 6,822,611 | B1 * | 11/2004 | Kontogeorgakis et al. | 343/702 |
| 7,003,318 | B2 * | 2/2006 | Kota et al. | 455/575.3 |
| 2003/0137468 | A1 * | 7/2003 | Kim | 343/702 |
| 2003/0234743 | A1 * | 12/2003 | Ponce De Leon et al. | 343/702 |
| 2005/0001773 | A1 * | 1/2005 | Morningstar et al. | 343/702 |
| 2005/0001775 | A1 * | 1/2005 | Liang et al. | 343/702 |
| 2005/0024274 | A1 * | 2/2005 | Byun et al. | 343/702 |
| 2005/0225487 | A1 * | 10/2005 | Fujii et al. | 343/702 |

FOREIGN PATENT DOCUMENTS

| | | |
|---|---|---|
| JP | 2001-284934 | 10/2001 |
| JP | 2003-078333 | 3/2003 |
| JP | 2003-234668 | 8/2003 |

OTHER PUBLICATIONS

"What is Insert Molding?", *Microplastics Inc.*, pp. 1-2. Printed off the Internet at http://www.microplasticsinc.com/what_is_insert_molding.htm, Sep. 26, 2007.

* cited by examiner

*Primary Examiner*—Douglas W. Owens
*Assistant Examiner*—Ephrem Alemu
(74) *Attorney, Agent, or Firm*—Finnegan, Henderson, Farabow, Garrett & Dunner, L.L.P.

(57) ABSTRACT

A portable terminal, which has an antenna disposed within a housing accommodating a circuit board, capable of securing a clearance between the antenna and parts of the circuit board, etc. within the housing without increasing the size of the housing, whereby the antenna performance can be prevented from degrading when transmitting or receiving, in which the antenna is insert-molded integrally with the housing accommodating the circuit board within it.

10 Claims, 8 Drawing Sheets

PORTABLE TERMINAL INCLUDING ANTENNA

CROSS-REFERENCE TO THE RELATED APPLICATION

This application is based upon and claims the benefit of priority from the prior Japanese Patent Application No. 2004-314175 filed on Oct. 28, 2004; the entire contents of which are incorporated herein by reference.

BACKGROUND OF THE INVENTION

1. Field of the Invention

The present invention relates to a portable terminal which has an antenna disposed within a housing for accommodating a circuit board, and more particularly to an embodiment of mounting the antenna.

2. Description of the Related Art

In order to improve the beauty and the like of an exterior design of, for example, a portable terminal such as a cellular phone, there are proposed those which have an antenna for communications disposed within a casing without exposing to the outside of the casing.

A portable terminal E shown in FIG. 7, FIG. 8A and FIG. 8B has a circuit board B, which has unshown various types of electronic parts mounted on it, within a casing (housing) C comprised of a lower case L and an upper case U which are mutually assembled and also has a communications antenna A disposed within the casing C.

The antenna A has a flat-plate antenna body Aa formed of a sheet metal such as stainless steel and a connection tongue piece Ab protruded from the antenna body Aa and is mounted in a prescribed position within the casing C by fitting the antenna body Aa into slits of ribs La, La formed in the lower case L.

Meanwhile, a connection spring S is attached to a connection pattern Bp, which is formed on the surface of the circuit board B, by means such as soldering or the like, and the connection tongue piece Ab of the antenna A assembled within the casing C as described above is contacted to the connection spring S so as to connect a communication circuit (not shown) configured on the circuit board B to the antenna A.

The above-described conventional portable terminal E has a structure in which the antenna A (antenna body Aa) is disposed between an end wall Le of the lower case L and an edge Be of the circuit board B. But, in the portable terminal E configured as described above, it is difficult to have a large clearance w between the edge Be of the circuit board B and the antenna A (antenna body Aa) because the space is limited, and there is a disadvantage that the antenna performance is degraded considerably when transmitting and receiving because the antenna A (antenna body Aa) is close to the circuit board B and various types of metallic substances disposed around the circuit board B.

With respect to the above disadvantage, the degradation in antenna performance when transmitting and receiving can be prevented by increasing the clearance w between the edge Be of the circuit board B and the antenna A (antenna body Aa) but there was a problem that the portable terminal E had an unexpectedly large appearance because the casing (housing) C became large as the clearance w was increased.

Under the circumstances as described above, the present invention provides a portable terminal which secures the clearance between the parts such as a circuit board in the housing and the antenna without involving an unexpected enlargement of the housing and can prevent the antenna performance from lowering when transmitting and receiving.

In the above-described conventional portable terminal E, the entire antenna A assembled to the ribs La, La in the lower case L is exposed within the casing C, and the edge portion of the flat-plate antenna body Aa, namely a ridgeline portion where a flat portion and a peripheral surface portion in the plate thickness direction meet each other, is also exposed, so that static electricity, which enters from the outside via a gap between the lower case L and the upper case U, tends to hit the edge portion, and if static electricity hits the antenna A, there was a possibility that the communication circuit connected to the antenna A was destroyed.

Under the circumstances described above, the present invention provides a portable terminal which can prevent the communication circuit from being destroyed even if static electricity from the outside hits the antenna.

And, the above-described conventional portable terminal E connects the communication circuit (not shown) configured on the circuit board B and the antenna A by contacting the connection spring S attached to the connection pattern Bp formed in the circuit board B to the connection tongue piece Ab disposed on the antenna A. Thus, the number of parts used for the connection of the antenna A and the communication circuit (not shown) was many, involving a disadvantage that the production process became complex.

Under the circumstances described above, the present invention provides a portable terminal which can achieve the reduction of the number of parts used for connection of the communication circuit on the circuit board and the antenna.

SUMMARY OF THE INVENTION

An aspect of the present invention provides a portable terminal having an antenna disposed within a housing for accommodating a circuit board, wherein the antenna is formed with the housing.

The portable terminal according to this aspect of the present invention has the antenna formed with the housing, so that a clearance between inside parts such as a circuit board and the antenna disposed within the housing can be made large, and an unexpected approach between the inside parts and the antenna can be prevented.

According to the portable terminal according to this aspect of the present invention, the clearance between the parts such as the circuit board and the antenna within the housing can be secured without increasing the size of the housing unexpectedly to prevent the antenna performance from degrading when transmitting and receiving.

Another aspect of the present invention provides a portable terminal having a circuit board between an outside case and an inside case which are formed of resin, wherein an antenna is at least partly built in either of the outside case and the inside case.

According to the portable terminal according to the another aspect of the present invention, the antenna is at least partly built in either of the outside case and the inside case, so that the clearance between the inside parts such as the circuit board and the antenna can be made large, the unexpected approach between the inside parts and the antenna can be prevented, and the antenna performance can be prevented from degrading when transmitting and receiving.

DETAILED DESCRIPTION OF THE INVENTION

The present invention will be described in detail with reference to the drawings showing embodiments.

FIG. 1 to FIG. 6 show an embodiment applying the present invention to a folding cellular phone which is one aspect of a portable terminal. A cellular phone 1 is provided with a lower housing 2 which has a transmitter portion and various operational portions and an upper housing 3 which has a receiver portion, a liquid crystal display and the like, and the lower housing 2 and the upper housing 3 are connected to freely open and close via a hinge section 4.

The lower housing 2, which configures the housing of the cellular phone 1 together with the upper housing 3, has a lower inside case 2I, a lower outside case 2O and a hinge cover 2H which are mutually assembled, and the lower inside case 2I, the lower outside case 2O and the hinge cover 2H are produced into a desired shape by die forming a resin material such as ABS (acrylonitrile butadiene styrene).

Figure 1B:
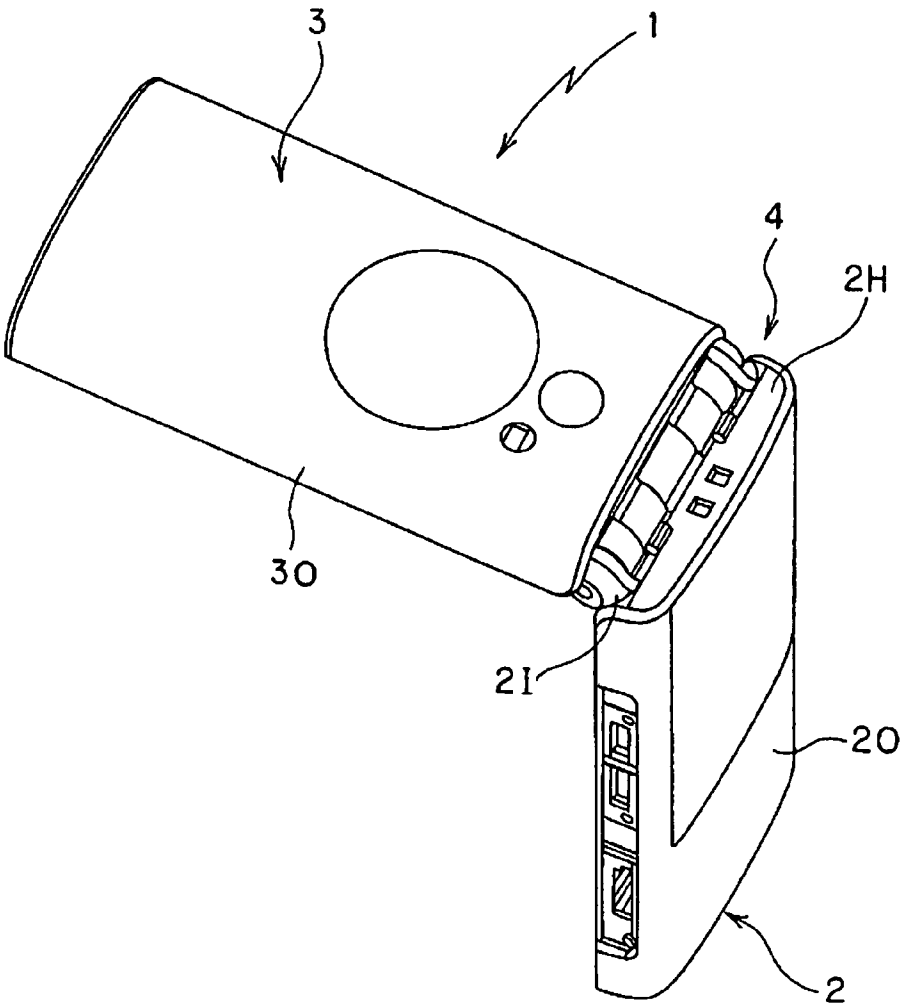
FIG. 1A and FIG. 1B are entire external appearance views showing a folding cellular phone as one embodiment of a portable terminal according to the present invention.
Figure 1A:
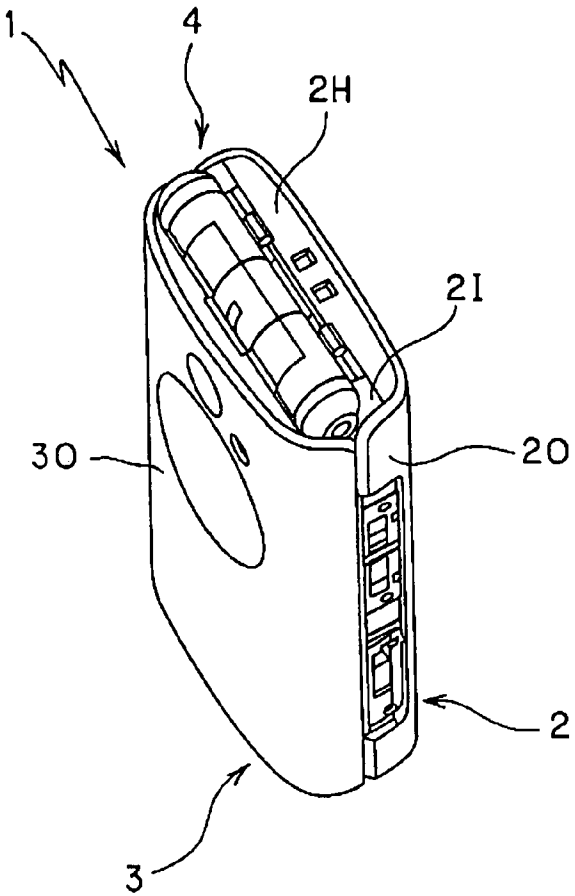
Figure 2:
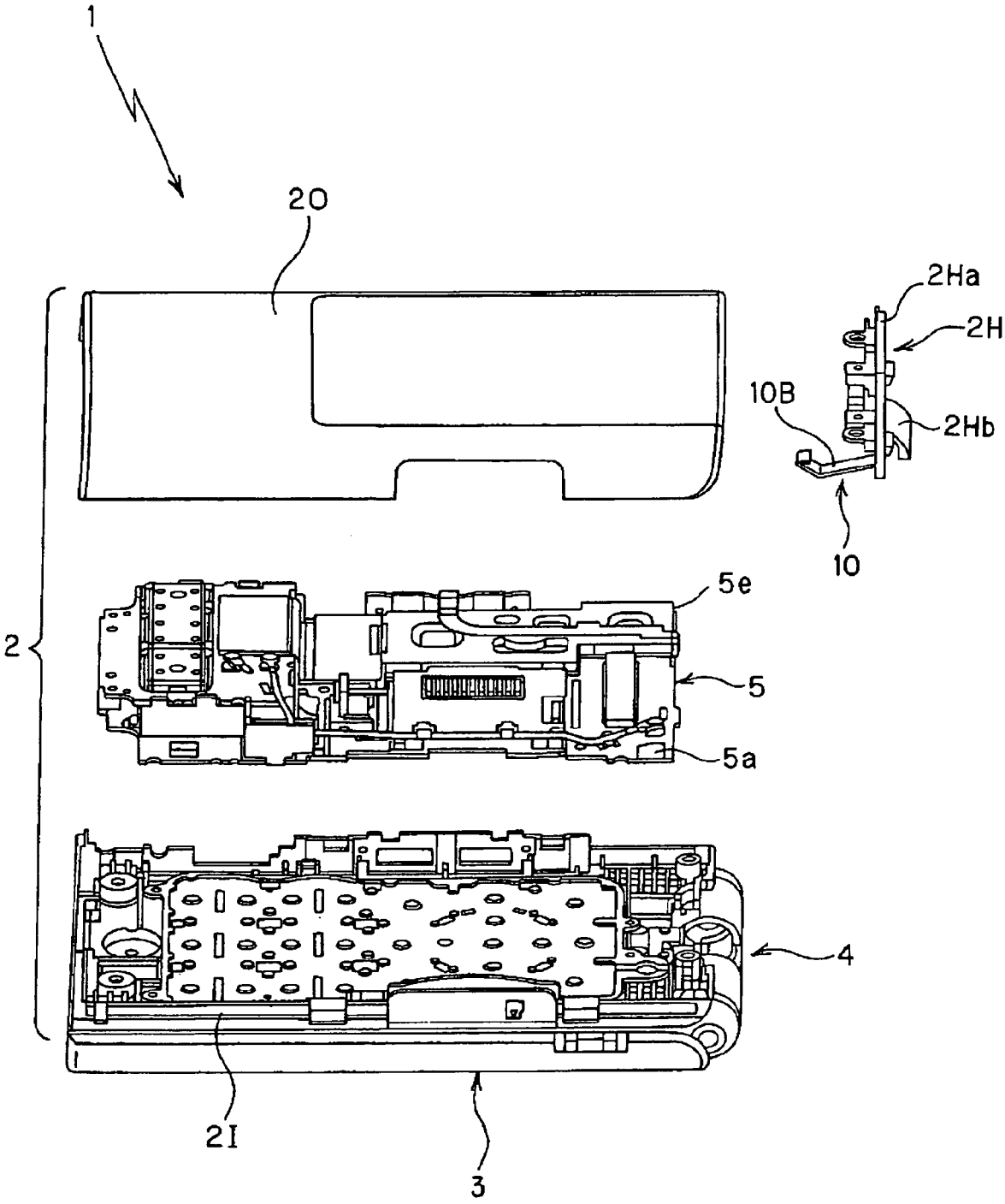
FIG. 2 is an exploded view of a lower housing of the cellular phone shown in FIG. 1.
Figure 3A:
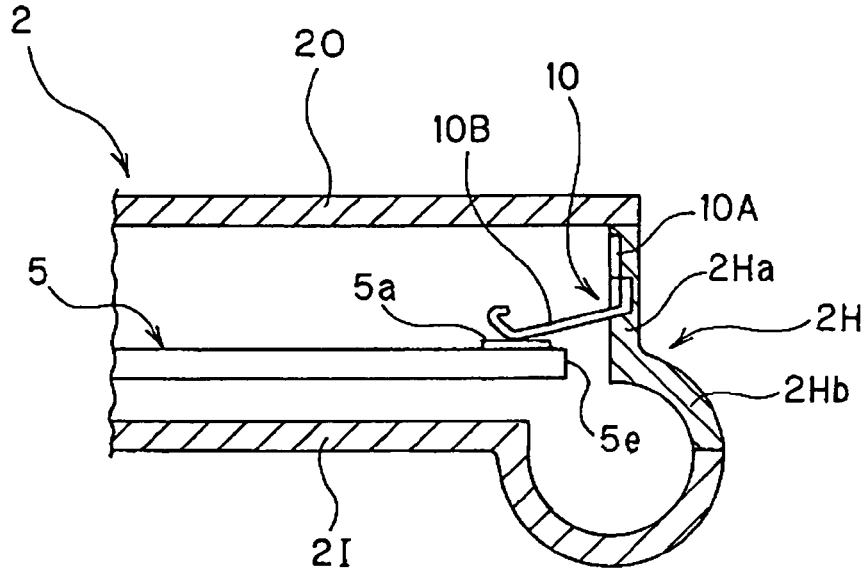
FIG. 3A and FIG. 3B are a side sectional view and a plan sectional view of the lower housing of the cellular phone shown in FIG. 1.
Figure 3B:
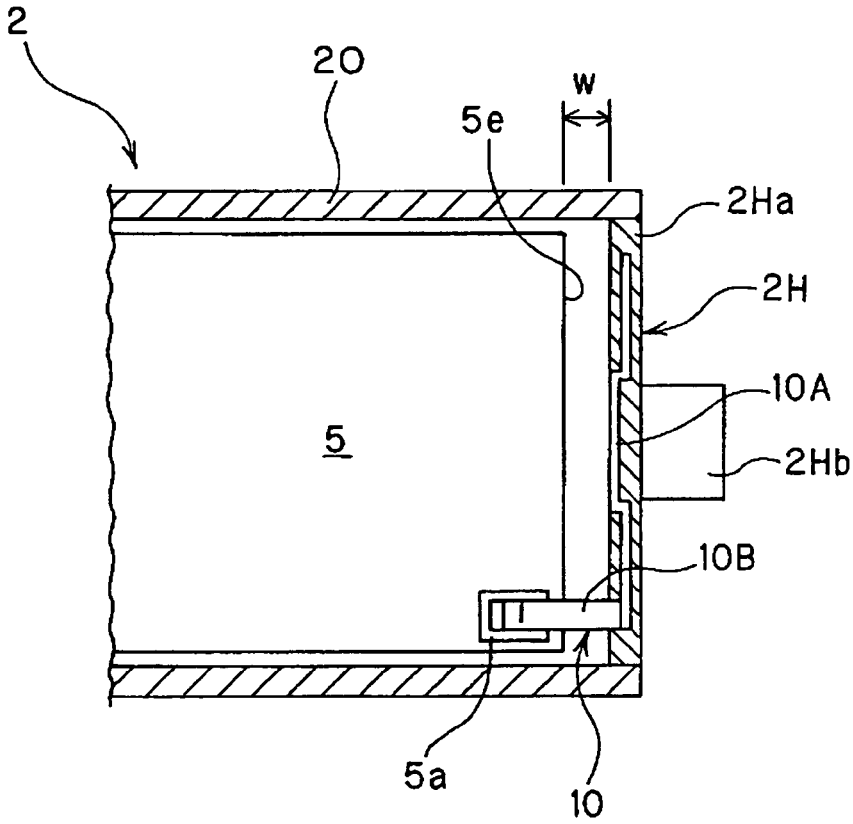
Figure 4A:
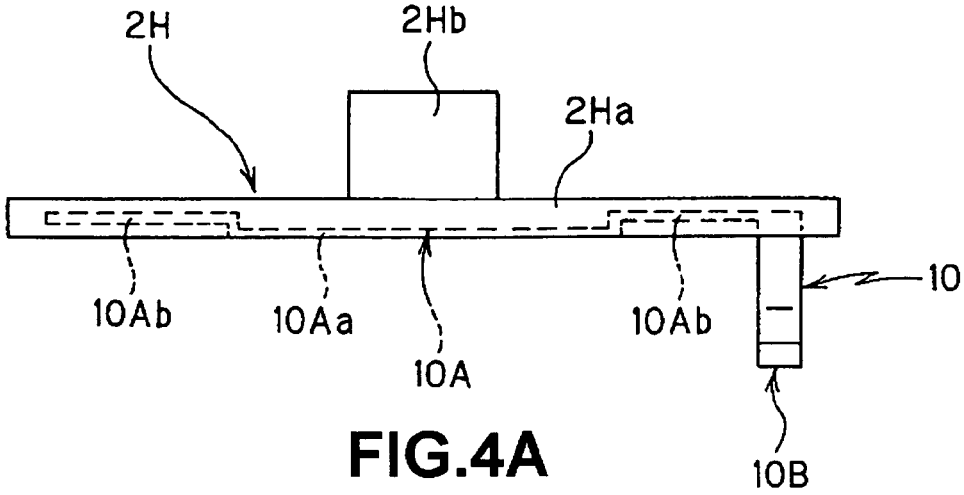
FIG. 4A, FIG. 4B and FIG. 4C are a plan view, a front view and a side view of a hinge cover of the lower housing of the cellular phone shown in FIG. 1.
Figure 4B:
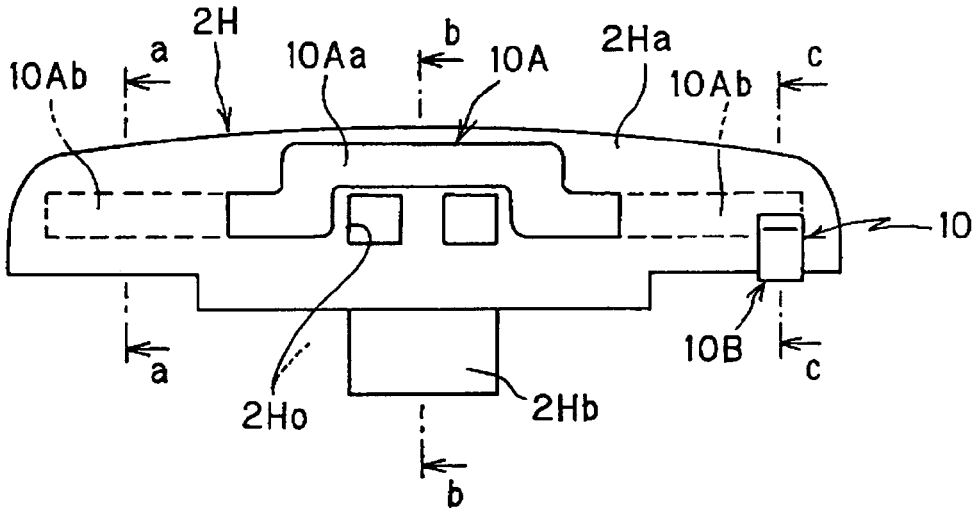
Figure 4C:
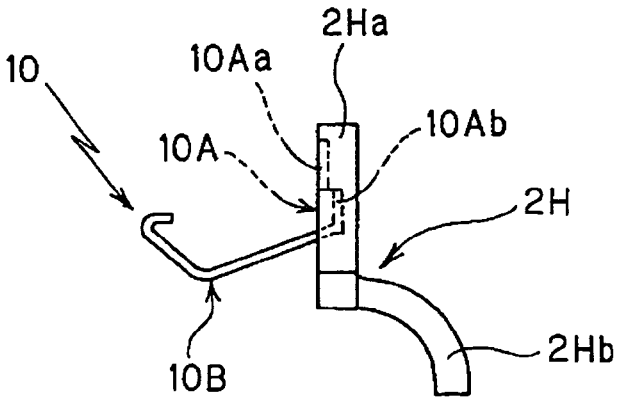
Figure 5A:
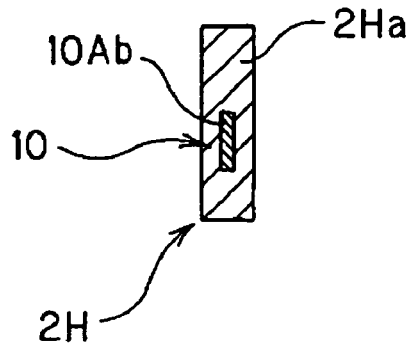
FIG. 5A, FIG. 5B and FIG. 5C are a sectional view taken along line a-a, a sectional view taken along line b-b and a sectional view taken along line c-c of FIG. 4.
Figure 5B:
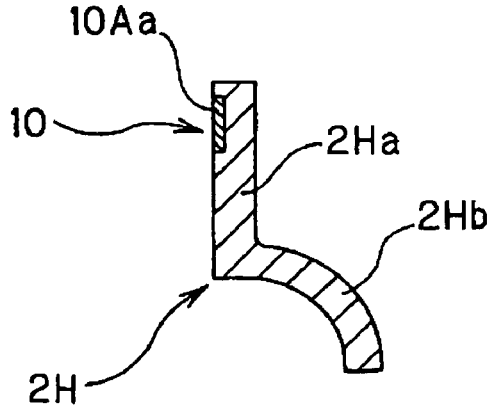
Figure 5C:
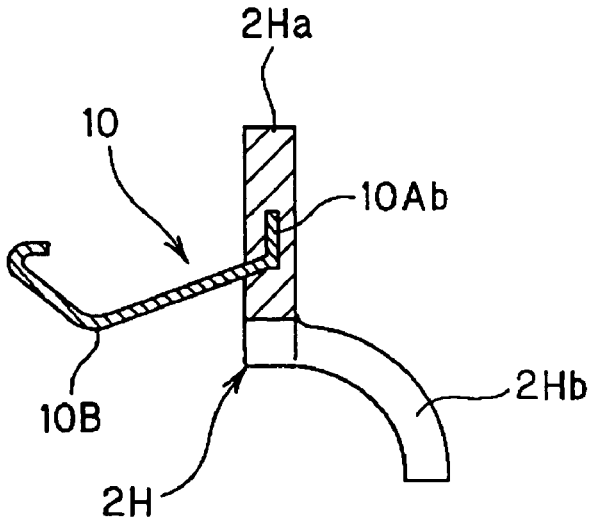
Figure 6A:
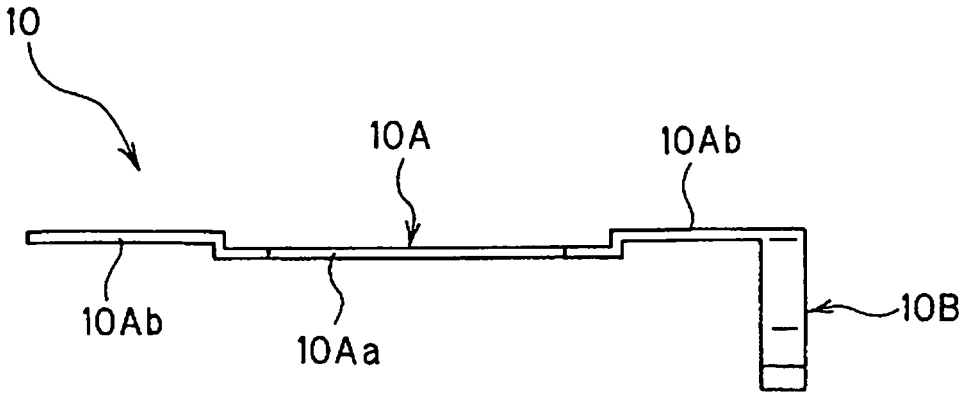
FIG. 6A, FIG. 6B and FIG. 6C are a plan view, a front view and a side view of an antenna of the cellular phone shown in FIG. 1.
Figure 6B:
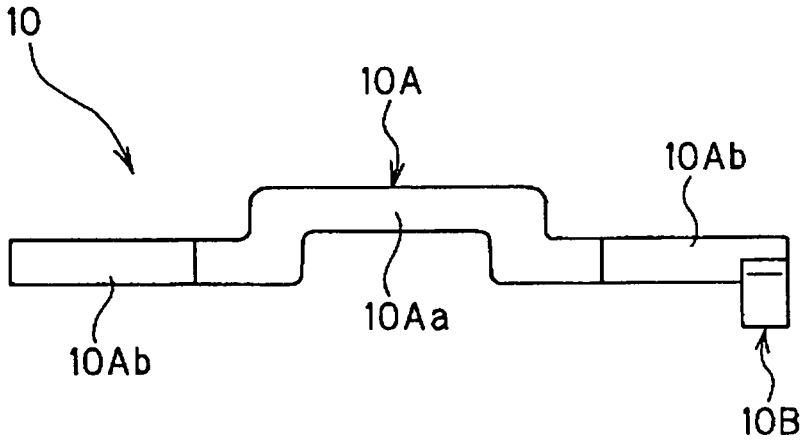
Figure 6C:
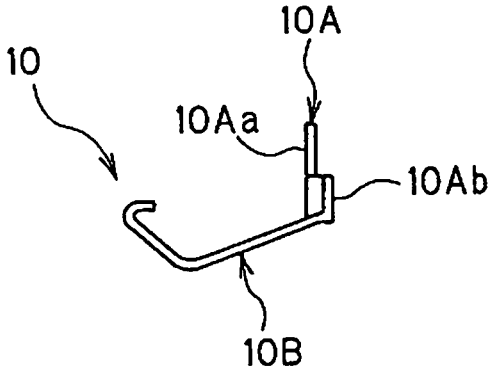
Figure 7:
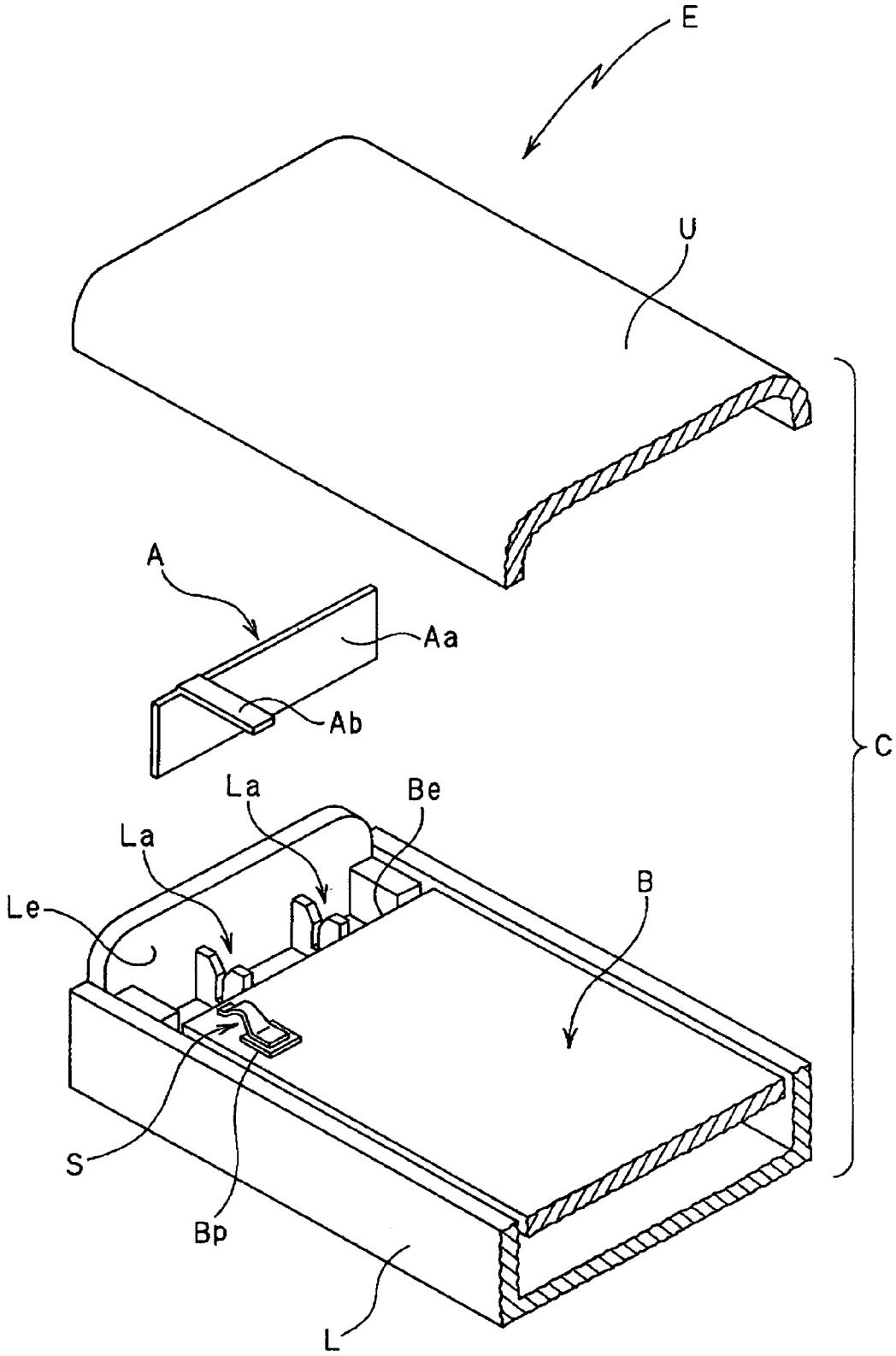
FIG.7 (PRIOR ART)
FIG. 7 is an exploded perspective view showing an aspect of mounting the antenna of a conventional portable terminal.
Figure 8A:
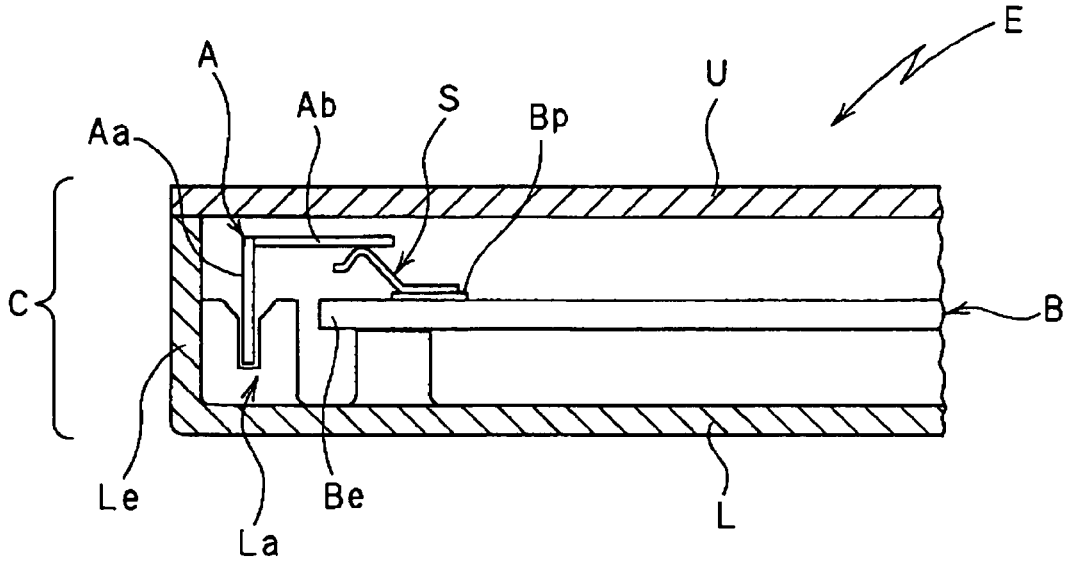
FIG.8A (PRIOR ART)
FIG. 8A and FIG. 8B are a side sectional view and a plan sectional view showing an aspect of mounting the antenna of the conventional portable terminal.
Figure 8B:
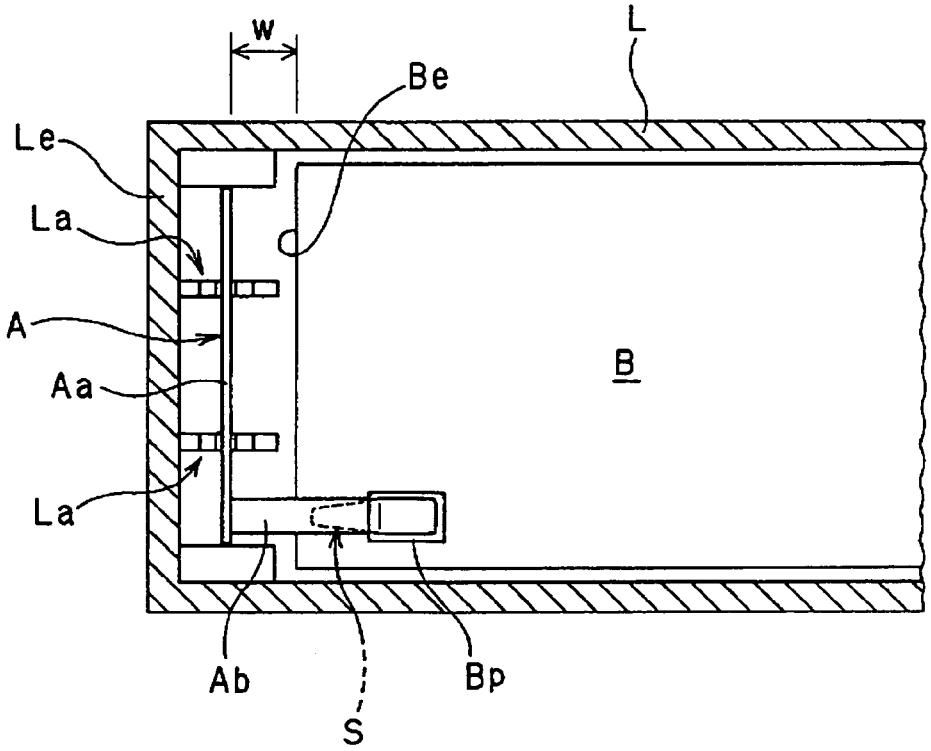
FIG.8B (PRIOR ART)

As shown in FIG. 2, FIG. 3A and FIG. 3B, a circuit board 5 is mounted within the lower housing 2, and various electronic parts are mounted thereon to configure a prescribed communication circuit (not shown) on the circuit board 5.

And, a connection pattern (board-side connection portion) 5*a* showing a land shape is formed on the surface of the circuit board 5 to connect the above-described communication circuit (not shown) and an antenna 10 to be described later.

Besides, various electronic parts, mechanical parts and the like are also mounted on the circuit board 5 in addition to the configuration of the communication circuit (not shown), and the circuit board 5 has its front and back surfaces covered with the lower inside case 2I and the lower outside case 2O and its edge portion 5*e* covered with the hinge cover 2H.

The hinge cover 2H is produced to have a flat-plate panel section 2Ha which configures one end of the lower housing 2 and a tongue portion 2Hb which protrudes from the panel section 2Ha to configure the external appearance of the hinge section 4 and has the antenna 10 to be described later formed integrally with the panel section 2Ha, specifically, by conducting insert molding integrally.

As sown in FIG. 3 to FIG. 6, the antenna 10 has a body portion (antenna body portion) 10A and a connection portion (antenna-side connection portion) 10B which is extended from the body portion 10A and is produced into a prescribed shape by, for example, stamping and folding a sheet metal such as stainless steel or the like.

The body portion 10A of the antenna 10 extends along substantially the overall width of the panel section 2Ha of the hinge cover 2H and shows a thin strip shape having a center portion 10Aa and end portions 10Ab, 10Ab which extend horizontally from the center portion 10Aa.

The center portion 10Aa of the body portion 10A is formed to have a crank-like flat shape in order to avoid a strap-mounting hole 2Ho formed in the panel section 2Ha of the hinge cover 2H, and the body portion 10A is bent at the boundary between the center portion 10Aa and the end portion 10Ab in order to improve the strength (rigidity) of the hinge cover 2H formed on the antenna 10.

The body portion 10A of the antenna 10 which is insert molded integrally with the panel section 2Ha of the hinge cover 2H is mostly covered with a resin material configuring the hinge cover 2H except that one side of the center portion 10Aa is exposed to the outside.

Here, the one side of the center portion 10Aa of the body portion 10A is on the same level with the surface of the panel section 2Ha of the hinge cover 2H, so that the edge of the center portion 10Aa does not protrude from the surface of the panel section 2Ha but is covered with the resin material configuring the hinge cover 2H, and the edge of the body portion 10A of the antenna 10 is entirely covered with the resin material configuring the hinge cover 2H.

Meanwhile, the connection portion (antenna-side connection portion) 10B of the antenna 10 shows a leaf spring-like shape which extends from the one end portion 10Ab of the body portion 10A toward the circuit board 5 accommodated in the lower housing 2, and the connection portion 10B is press contacted by its elastic force to the connection pattern (board-side connection portion) 5*a* formed on the circuit board 5.

As described above, the mutual contact between the connection portion (antenna-side connection portion) 10B and the connection pattern (board-side connection portion) 5*a* effects the connection between the communication circuit (not shown) configured on the circuit board 5 and the antenna 10 formed on the hinge cover 2H.

In the cellular phone 1 configured as described above, the antenna 10 is insert molded integrally with the hinge cover 2H configuring the lower housing (housing) 2, so that the clearance w between the antenna 10, more specifically the body portion 10A of the antenna 10, and the edge portion 5*e* of the circuit board 5 can be set large without increasing the size of the lower housing (housing) 2 as shown in FIG. 3.

Thus, an unexpected approach between the circuit board 5 and the inside parts formed of various types of metals disposed around the circuit board 5 and the antenna 10 is prevented by the cellular phone 1 configured as described above, and the antenna performance when transmitting and receiving can be prevented from degrading without increasing the size of the housing unexpectedly.

And, the cellular phone 1 configured as described above can prevent the communication circuit from being destroyed by static electricity which hits the antenna 10 from the outside because the antenna 10 is insert molded in the hinge cover 2H and the edge of the body portion 10A which tends to be hit by static electricity is covered with the resin material configuring the hinge cover 2H.

According to the cellular phone 1 configured as described above, the leaf spring-like connection portion (antenna-side connection portion) 10B disposed on the antenna 10 is directly contacted to the connection pattern (board-side connection portion) 5*a* formed on the surface of the circuit board 5 to effect the contact between the antenna 10 and the circuit board 5, so that the number of parts used for connection of the antenna 10 and the circuit board 5, specifically the communication circuit on the circuit board 5, can be reduced.

Here, in the above-described cellular phone 1, the strength of the hinge cover 2H is improved considerably because the antenna 10 is insert molded in such a small part as the hinge cover 2H. Specially, the hinge cover 2H is a component element of the hinge section 4 for coupling the lower housing 2 and the upper housing 3 and required to have strength, so that the increase in strength by forming the antenna 10 is quite effective.

Because the antenna 10 is inserted into a small part such as the hinge cover 2H, forming variation (forming deformation) when producing can be suppressed from occurring. Specifically, the antenna 10 is inserted to fill substantially the hinge cover 2H, so that they have a different thermal expansion coefficient in comparison with a case that a relatively small antenna is formed integrally with a large part, but they have a relatively close dimensional ratio and volume ratio. Therefore, molding distortion resulting from thermal contraction of the material when producing is little, and molding variation among the individual products can be suppressed.

In the above-described cellular phone 1, a part of the antenna 10 insert molded integrally with the hinge cover 2H, specifically one side surface of the center portion 10Aa of the body portion 10A, is exposed, but the entire body portion 10A can be insert molded such that it is fully inserted into the hinge cover 2H, and it is needless to say that such a configuration is quite effective measures against static electricity.

And, the shape of the body portion 10A of the antenna 10 is not limited to the embodiment, and the body portion 10A is not limited to the thin strip shape but may naturally be determined appropriately to have, for example, a rod shape, a ring shape or the like according to the design specifications of the cellular phone 1.

In the above-described cellular phone 1, the antenna 10 is insert molded integrally with the hinge cover 2H, but the position of the housing for forming the antenna is not limited to the embodiment but may naturally be selected to be, for example, the lower outside case 2O of the lower housing 2. In this connection, when an antenna formed of a metal material is insert molded into an upper outside case 3O of the upper housing 3 (see FIG. 1), the rigidity of a flat part is improved, and the antenna performance is also expected to be improved because the outside case 3O is turned to the outside when the cellular phone 1 is in use.

In the above-described cellular phone 1, the leaf spring-like connection portion (antenna-side connection portion) 10B disposed on the antenna 10 is connected to the connection pattern (board-side connection portion) 5*a* formed on the circuit board 5, but it can also be configured to have a part of the body portion as the connection portion (antenna-side connection portion) instead of the leaf spring-like connection portion to contact the leaf spring-like connection portion (board-side connection portion) disposed on the circuit board 5 so as to effect the connection between the antenna and the communication circuit.

In the above-described embodiment, the connection portion (antenna-side connection portion) 10B of the antenna 10 and the connection pattern (board-side connection portion) 5*a* of the circuit board 5*a* are contacted to connect the antenna and the communication circuit, but it is also possible to configure so-called capacity coupling such that the antenna and the communication circuit are connected without contacting.

In the above-described embodiment, the antenna 10 is integrally formed with the hinge cover 2H by the insert molding, but it is needless to say that the antenna 10 and the hinge cover 2H or various types of parts and the antenna can be formed integrally by outsert molding.

Besides, in the above-described embodiment, an example of applying the present invention to the folding cellular phone which is one aspect of the portable terminal was described. But, it is needless to say that the present invention can be applied quite effectively to not only wireless communication equipment such as various types of cellular phones or cordless handsets of cordless phones but also portable terminals such as PDA (personal data assistance) having transmitting and receiving functions. In this connection, it is needless to say that the present invention can be applied effectively to a portable terminal provided with a transmission function or a reception function only, e.g., a portable terminal such as a handy GPS (global positioning system) receiver, if it is provided with an information carrying function (communication function) based on wireless by using the antenna.

What is claimed is:

1. A cellular phone, comprising:

a circuit board for communication;

a housing, including a hinge assembly, for accommodating the circuit board, the housing formed of a resin material; and an antenna formed in the hinge assembly and connected to the circuit board, the antenna including a body portion and a connecting portion extending from the body portion;

wherein the body portion is insert molded integrally in the resin material and the connecting portion is exposed in the housing.

2. The cellular phone according to claim 1, wherein the housing includes an upper housing with an upper outside case and a lower housing, and wherein the antenna is integrally formed in the upper outside case.

3. The cellular phone according to claim 1, wherein the body portion is bent at a boundary between a center portion and an end portion of the antenna.

4. The cellular phone according to claim 1, wherein the cellular phone is a folding portable terminal including an upper housing and a lower housing coupled via the hinge assembly, wherein the upper housing includes an upper outside case, and the lower housing includes a lower outside case and a lower inside case, wherein when the portable terminal is in a folded position, the lower inside case is positioned in between the upper outside case and the lower outside case, and wherein the antenna is integrally formed in the upper outside case.

5. The cellular phone according to the claim 1, wherein at least a portion of the antenna body portion is entirely covered by the resin material of the housing.

6. The cellular phone according to claim 1, wherein the antenna body portion is shaped from a flat sheet of metal.

7. The cellular phone according to claim 1, wherein a side surface of a center portion of the antenna body portion is exposed to an outside portion of the housing, and wherein an end portion of the antenna body portion extends from the center portion and is covered by the resin material of the housing.

8. The cellular phone according to claim 1, wherein the housing includes an outside case and an inside case each formed of a resin material, and wherein the antenna body portion is integrally formed in the resin material in either the outside case or the inside case, and the connecting portion is for connecting to the circuit board.

9. The cellular phone according to claim 1, wherein the connecting portion contacts a board-side connection portion in the circuit board to form a connection between the antenna and the circuit board.

10. The cellular phone according to claim 9, wherein at least one of the connecting portion and the board-side connection portion is press contacted to the other by an elastic force.

* * * * *